US005613911A

United States Patent [19]

Takemoto et al.

[11] Patent Number: 5,613,911

[45] Date of Patent: Mar. 25, 1997

[54] GAME APPARATUS HAVING GAME MEDIA CONTROLLING CAPABILITIES

[75] Inventors: Takatoshi Takemoto; Kazunari Kawashima, both of Tokyo, Japan

[73] Assignee: Kabushiki Kaisha Ace Denken, Tokyo, Japan

[21] Appl. No.: 200,899

[22] Filed: Feb. 23, 1994

Related U.S. Application Data

[63] Continuation-in-part of Ser. No. 146,209, filed as PCT/JP92/00637, May 18, 1992, published as WO92/20415, Nov. 26, 1992, abandoned.

[30] Foreign Application Priority Data

| | | | |
|---|---|---|---|
| May 17, 1991 | [JP] | Japan | 3-112015 |
| Jun. 19, 1991 | [JP] | Japan | 3-147474 |
| Jun. 19, 1991 | [JP] | Japan | 3-147475 |

[51] Int. Cl.[6] ..... A63F 9/24

[52] U.S. Cl. ..... 463/25; 463/29; 463/20; 463/3

[58] Field of Search ..... 273/138 A, 143 R, 273/121 B; 364/412; 463/1, 3, 20, 25, 29–31

[56] References Cited

U.S. PATENT DOCUMENTS

| | | | |
|---|---|---|---|
| 5,010,995 | 4/1991 | Okada | 273/138 A |
| 5,113,990 | 5/1992 | Gabrius et al. | 364/412 |

FOREIGN PATENT DOCUMENTS

| | | | |
|---|---|---|---|
| B-21970/88 | 2/1991 | Australia . | |
| 360613 | 3/1990 | European Pat. Off. . | |
| 2803214 | 7/1979 | Germany . | |
| 3441518 | 5/1986 | Germany . | |
| 5252726 | 4/1977 | Japan | 273/121 B |
| 59-108580 | 6/1984 | Japan . | |
| 61-238268 | 10/1986 | Japan . | |
| 63-51881 | 3/1988 | Japan . | |
| 1-135383 | 5/1989 | Japan . | |
| WO91/02572 | 3/1991 | WIPO . | |

*Primary Examiner*—Jessica Harrison
*Assistant Examiner*—Mark Sager
*Attorney, Agent, or Firm*—Lowe, Price, LeBlanc & Becker

[57] ABSTRACT

A game apparatus 10 has a game executing unit 70 for playing a game using game media and a game media holding unit 32 for temporarily holding the game media used in the game. The game apparatus 10 comprises a reception processing unit 11 for receiving input operations which are performed by a player who desires to rent game media and for outputting information representative of the number of rented game media; a replenishing processing unit 12 for processing the replenishing of the game media to the game media holding unit 32 according to the request of the player and for outputting information representative of the replenished game media; a score output unit 71 for outputting information representative of the number of game media given to the player as a score during performance of the game; a number managing unit 13 for accepting the information representative of the number of rented game media, the information representative of replenished game media and the information representative of the number of game media given to the player as a score to manage the number of game media acquired by the player in the game machine; and an adjustment processing unit 14 which responds to an instruction of adjustment to accept information representative of the number of game media possessed by the player, which is managed by the number managing unit 13 to output information representative of the number of game media to the storage medium.

23 Claims, 13 Drawing Sheets

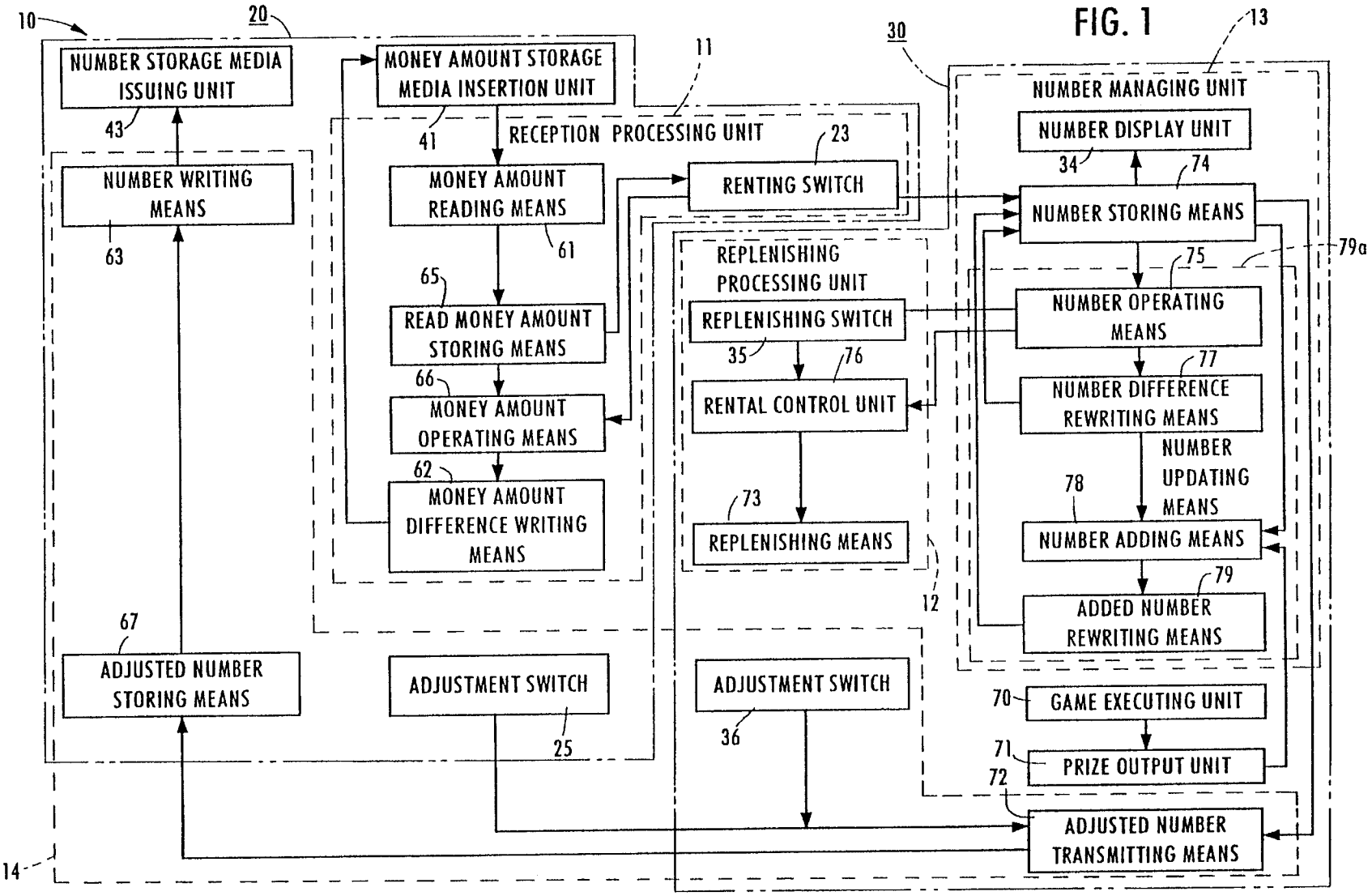
FIG. 1
NUMBER MANAGING UNIT
NUMBER DISPLAY UNIT
NUMBER STORING MEANS
NUMBER OPERATING MEANS
NUMBER DIFFERENCE REWRITING MEANS
NUMBER UPDATING MEANS
NUMBER ADDING MEANS
ADDED NUMBER REWRITING MEANS
GAME EXECUTING UNIT
PRIZE OUTPUT UNIT
ADJUSTED NUMBER TRANSMITTING MEANS
RENTING SWITCH
REPLENISHING PROCESSING UNIT
REPLENISHING SWITCH
RENTAL CONTROL UNIT
REPLENISHING MEANS
ADJUSTMENT SWITCH
RECEPTION PROCESSING UNIT
MONEY AMOUNT STORAGE MEDIA INSERTION UNIT
MONEY AMOUNT READING MEANS
READ MONEY AMOUNT STORING MEANS
MONEY AMOUNT OPERATING MEANS
MONEY AMOUNT DIFFERENCE WRITING MEANS
ADJUSTMENT SWITCH
NUMBER STORAGE MEDIA ISSUING UNIT
NUMBER WRITING MEANS
ADJUSTED NUMBER STORING MEANS
10
11
12
13
14
20
23
25
30
34
35
36
41
43
61
62
63
65
66
67
70
71
72
73
74
75
76
77
78
79
79a

GAME APPARATUS HAVING GAME MEDIA CONTROLLING CAPABILITIES

This application is a continuation in part of application Ser. No. 08/146,209, filed as PCT/JP92/00637, May 18, 1992 published as WO92/20415, Nov. 26, 1992, now abandoned.

TECHNICAL FIELD

The present invention relates to a game apparatus having game media controlling capabilities and in particular to a game apparatus having game media controlling capabilities, which can execute rental of the game media, supply of the game media to game machines and adjustment of the number of game media on completion of the game.

BACKGROUND TECHNOLOGY

In game parlors, there are generally provided one or more types of game machines, game media renting apparatus (game media renting machines) for renting a predetermined number of game media such as metal balls, or metaldiscs, used in the game machines and game media counters which count the number of game media which are acquired or possessed by players and recover the game media on completion of the game.

Game machines are used which initiate a game upon insertion of game media therein and dispense a predetermined number of game media as a score when a given condition is established during the game.

Examples of such game machines include slot or reel machine, pinball game machines, etc.

Some game media renting machines release a predetermined number of game media when paper money or coins are inserted into the machine and an amount of money corresponding to the number of game media to be rented is selected by depressing switches and the like. The other game media renting machines release a predetermined number of game media when a storage medium such as prepaid card bearing information representative of an amount of money or its value is inserted thereinto.

In game parlors which are equipped with such instruments, players heretofore have performed the game as follows:

A player initially inserts a prepaid card into an appropriate slot of the game media renting machine and rents the game media by operating renting switches.

Then, he or she begins to play the game by putting the game media into a game media holding tray of the game machine. When a predetermined condition, in which, for example, one or more game media which were inserted into the game machine fall into a given hole formed in the game machine is established during the game, a predetermined number of game media are given to the player from the game machine as a score. On completion of the game, the acquired game media are input into a counter for counting the game media. The player receives a receipt recording the count from the counter and takes the receipt to a prize exchange booth in order to exchang the receipt with a prize or prizes.

However, there have been various problems in handling the game media from the beginning of the game to the exchange with prize in such a prior art.

In other words, in order to begin the game or to replenish the game media, it is necessary to receive the game media from a game media renting machine and to move them to the game media holding tray of the game machine. Since a number of game media are usually discharged simultaneously from the game media renting machine, the player receives the discharged game media in his hands and carries them to the game media holding tray. This method of working is not necessarily easy for an unexperienced player. Therefore, the game media may often fall on the floor.

After playing the game, it is necessary to carry the acquired game media to the counter. It is necessary to transfer the game media in the game media holding tray to a portable tray, to carry the portable tray to the counter and to throw them into the counter. Also in this case, the game media may often fall on transferring of the game media. Since the counters are not often disposed in the vicinity of the game machines, it is not easy to carry a large number of bulky and heavy game media to the counter.

In such a manner, it is necessary for the players to handle the game media from the beginning of the game to the end of the game. Accordingly, this is troublesome to the players. This is not preferable. Loss of the game media due to falling incurs a loss to the players and fallen game media will scatter over the floor of the game parlor, which is not preferable for control of the game media.

It is necessary to reserve an excess of the game media since the game media are discharged from the game machines and the game media renting machines. If the number of game media runs low, it is necessary to replenish the game media. To this end, the game media which were recovered by the counters have to be transported to the game machines.

Accordingly, in order to do this, a complicated and expensive transporting system is necessary.

DISCLOSURE OF THE INVENTION

The present invention was made to overcome the problems in the prior art. It is therefore an object to provide a game apparatus in which a loss to the game player or problems in controlling of the game media are prevented from occurring by obviating troublesome handling of the game media by game players such as transferring or transporting of the game media from the beginning to the end of the game.

It is another object of the present invention to provide a game apparatus in which a shortage of game media can be prevented from occurring without requiring any large scale game media transporting system.

In order to accomplish the above mentioned object, in an aspect of the present invention, there is provided a game apparatus having a game executing unit for playing a game using game media and a game media holding unit for temporarily holding the game media used in the game, which has a game media controlling capability comprising a reception processing unit for receiving input operations which are performed by a player who desires to rent game media and for outputting information representative of the number of rented game media; a replenishing processing unit for processing the replenishing of the game media to the game media holding unit according to the request of the player and for outputting information representative of the replenished game media; a score output unit for outputting information representative of the number of game media given to the player as a score during performance of the game; a number managing unit for accepting the information representative of the number of rented game media, the information representative of replenished game media and the information representative of the number of game media given to the player as a score to manage the number of game media acquired by the player in the game machine; and an adjustment processing unit which responds to an instruction of adjustment and accepts information representative of the number of game media possessed by the player, which is managed by the number managing unit to output information representative of the number of the game media to the storage medium, said replenishing processing unit having a control capability of replenishing the game media within the number of game media possessed by the player.

The reception processing unit may comprise money amount reading means for reading information representative of an amount of money from a valuable medium having information representative of the amount of money and having a value corresponding to the amount of money represented by the information, which is inserted from the outside of the apparatus; read money amount storing means for temporarily storing the read amount of money, a renting switch for accepting a specified amount of rented game medium and for outputting information representative of the number of the game media which were specified for rent, and money amount calculating means for using the amount of money stored in the read money amount storing means and information representative of the number of the rented game media to calculate the amount of money stored in the read money amount storing means and the amount of money corresponding to the number of rented game media.

BRIEF DESCRIPTION OF THE DRAWINGS

FIG. 1 is a functional block diagram of a game apparatus showing a first embodiment of the present invention;

BEST MODES FOR EMBODYING THE INVENTION

Now, embodiments of the present invention will be described with reference to drawings.

Figure 2:
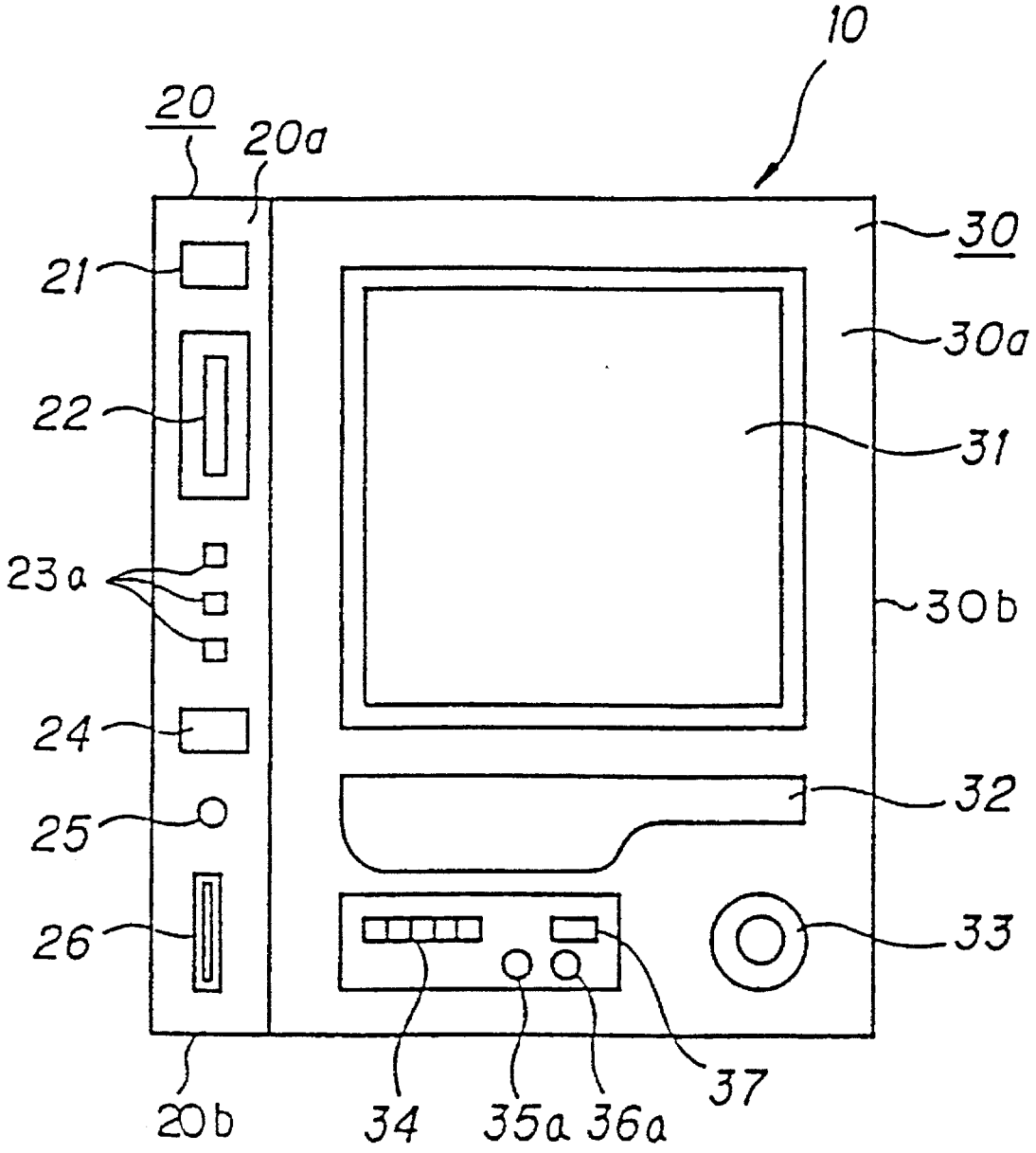
FIG. 2 is a front view of the game apparatus showing the first embodiment of the present invention.
Figure 7:
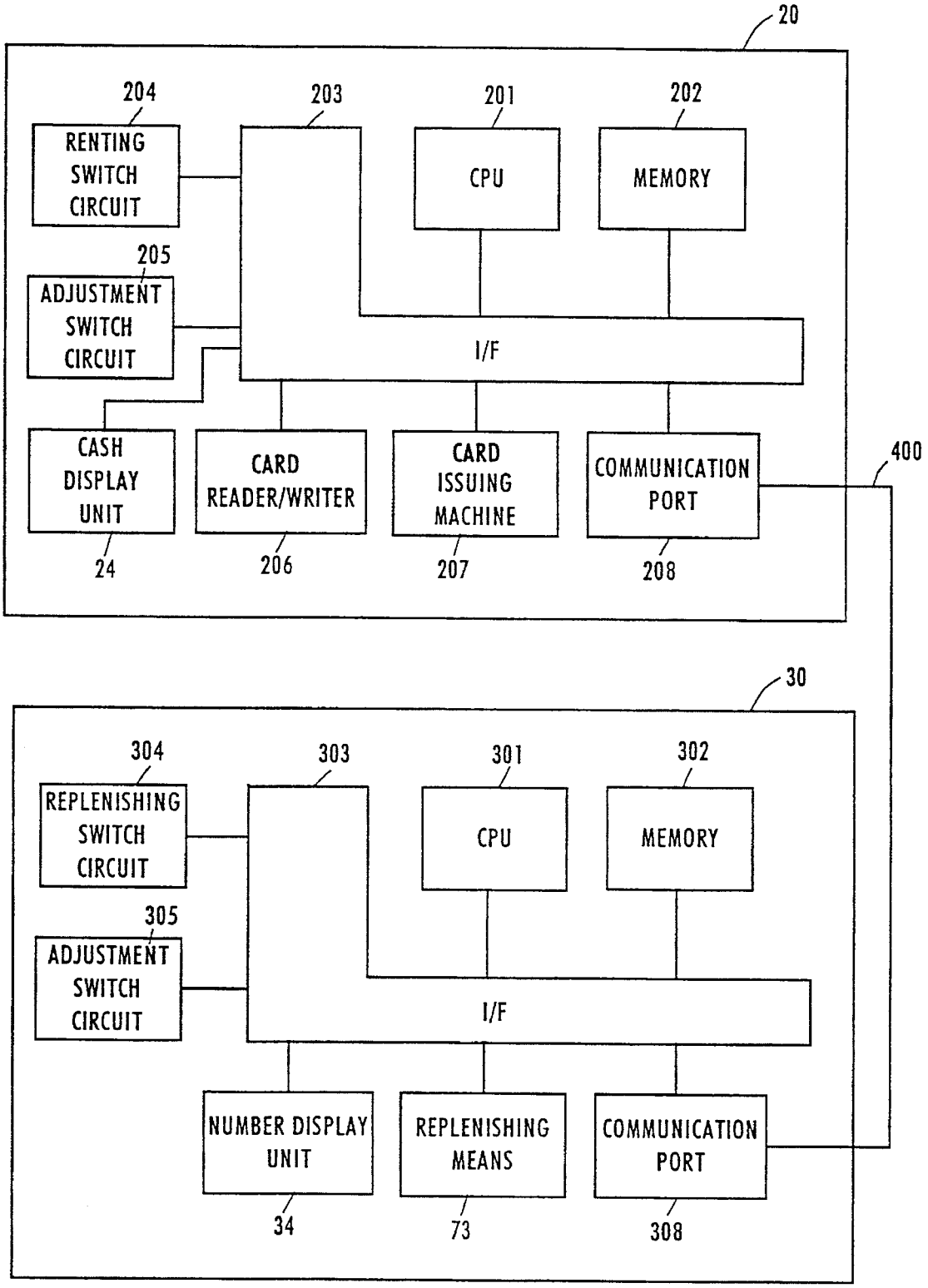
FIG. 7 is a block diagram showing a hardware system configuration of a game media renting machine and a game machine which form a game parlor system of the present invention.
Figure 8:
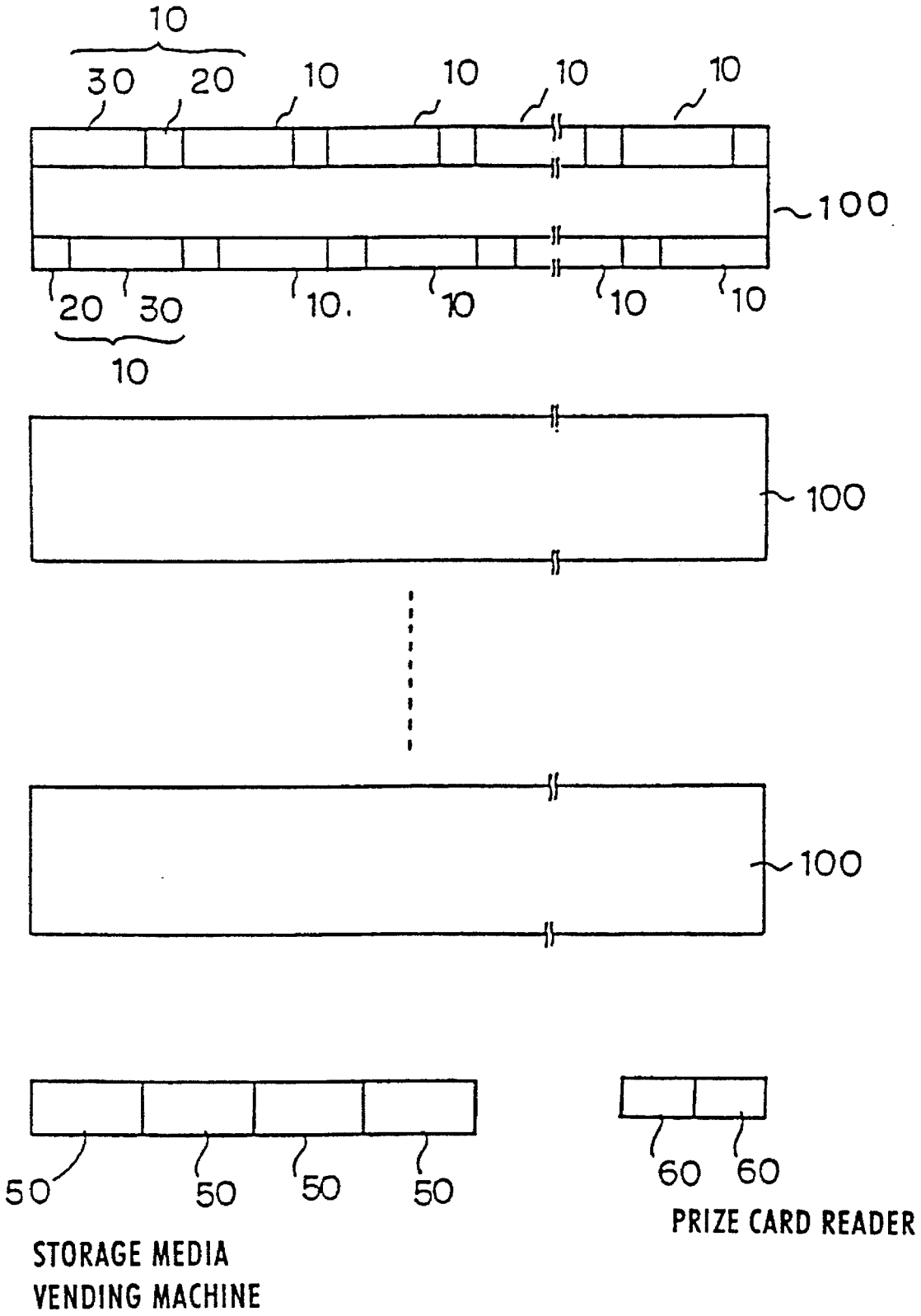
FIG. 8 is a block diagram showing the outline of the structure of a game parlor system of the present invention.

The functional configuration of a first embodiment of a game apparatus of the present invention is shown in FIG. 1. The appearance of the present embodiment is shown in FIG. 2. An example of the layout of a game parlor in which a game apparatus of the present embodiment is disposed is shown in FIG. 8. An example of a hardware system configuration of the present embodiment is shown in FIG. 7.

The game apparatus of the present embodiment is disposed in, for example, a game parlor shown in FIG. 8. In the game apparatus shown in FIG. 8, a plurality of arrays of assemblies 100 each comprising two arrays of plural game apparatus 10 are provided in a parallel manner and a plurality of storage media vending machines 50 and a plurality of score card readers 60 are disposed. The storage media vending machines 50 are adapted to vend storage media which will become media for storing the amount of money and the number of game media. The score card readers 60 are adapted to read the contents stored in the storage media, which are replaced with a score as will be described hereafter.

The game apparatus 10 comprises a game executing unit 70 for playing a game using game media, a main body of a game machine 30 having a game media holding unit 32 for temporarily holding game media used for the game and a game media renting machine unit 20 which functions as a game media renting machine. The main unit 30 of the game machine and the game media renting machine unit 20 are housed in different housings **30*b* and 20*b*, respectively, which are adjacent to each other. 0f course, the game media renting machine unit 20 and the main body 30 of the game machine may be disposed in the same housing. These components need not necessarily be housed in a definitely separated manner. In other words, the game media renting machine unit 20 may be disposed in the main body 30** of the game machine.

If the main body 30 of the game machine and the game medium renting machine body 20 are separately provided, there is an advantage that it suffices to exchange only part of the components, should the need to be exchanged arise.

The main body 30 receives and transmits signals to and from the game media renting machine unit 20 for achieving renting/adjustment of the game media. The game executing unit 70 of the main body 30 of the game machine executes a game using the game media in the rented media holding unit 32 and determines a hit when a particular condition is satisfied and outputs information (or a signal) to give a predetermined number of game media as a score to a player from a score output unit 71 which will be described hereafter.

The game machine main body 30 includes a board 31 on the front side **30*a* thereof, which forms a game zone, a rented media holding unit 32 for temporarily holding game media used for the game, and a lever 33 for ejecting the game medium in the rented media holding unit 32 toward the board 31. The board 31** is arranged in such a manner that the state of the game with the game media can be viewed.

The game main body 30 further includes a number display unit 34 for displaying the number of game media which are owned by the player who is currently playing the game apparatus 10 (hereinafter referred to as "possessed number"), an operating unit **35*a* for a replenishing switch, an operating unit 36***a* for a adjusting switch and a hitting-stop display lamp 37 for indicating completion of the operation of the game apparatus 10. The number display unit 34 may be used for displaying the number of rented game media and the number of overflown media of the game media which were supplied to the rented media holding unit 32 as well as the possessed number. The replenishing switch operating unit 35*a* is provided to enable a player to actuate the operating switch 35 which will be described hereafter. When no game media are left in the rented media holding unit 32 although the number is displayed, the game media within the displayed number can be replenished to the rented media holding unit 32 by actuating this replenishing switch operating unit 35*a*. The hitting stop display lamp 37 indicates that the operation is completed by lighting or blinking.

The game apparatus of the present embodiment includes, for example, a pachinko (pinball) machine, a reel machine and the like as a game execution unit 70. The above mentioned board 31 and the lever 33 constitute part of a component of the game execution unit 70.

In the case of pachinko (pinball) game machine, the game media used in the game media renting machine 20 and the game machine main body 30 are metal balls which are referred to as game media. Medals are used as the game media in the case of reel or slot machines.

In game parlors, it is generally necessary to rent game media before playing a game.

In order to rent game media, it is necessary to pay a rental charge in some form. In the present invention, valuable media, that is, media having information representative of the amount of money and having a value equivalent to the amount of money represented by the information for at least that game apparatus are used for paying a charge for renting of the game media. The valuable media may include media which store the amount of money in the form of electronically coded information or media which may indicate the amount of money in the form of image information. The former media are media for storing the amount of money which will be described hereafter. The latter media are notes or coupons bearing the amount of money.

Figure 4:
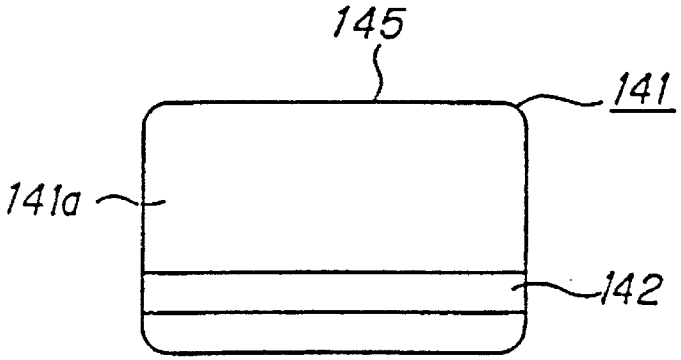
FIG. 4 is a front view showing an example of a money amount storage medium which is used in the present invention.

In the present embodiment, a storage medium for storing the amount of money 141 (hereinafter referred to as money amount storage medium) shown in FIG. 4 is used when the game media are rented. The money amount storage medium 141 comprises, for example, a board 145 which is in the form of a card and a money amount storing portion 142 which is provided on one side 141*a* of the board 141 in a strip manner. The money amount storing unit 142 is a magnetic recording strip which is capable of magnetically recording data thereon. The typical money amount storage media of this type are prepaid cards.

The money amount storing medium 141 is vended from, for example, a storage media vending machine 50 which has a cash insertion slot 51, selection button switches 52, a storage medium dispensing slot 53 and a change dispensing slot 54 on the front side thereof. If paper money is inserted into the cash throw slot 51 and one of the selection button switches 52 is depressed to select which money amount storage medium 141 is bought, a selected money amount storage medium 141 is dispensed from the storage media dispensing slot 53 and change is dispensed from the change dispensing slot 54.

The game media renting machine unit 20 transmits and receives signals to and from the game machine main body 30 to perform game media renting processing and adjustment processing. The game media renting machine unit 20 has on the front side 20*a* thereof a pilot lamp 21, an insertion slot 22 for the money amount storage medium 141, a dispensing slot 26 for dispensing a medium 143 for storing the number of game media, a renting switch actuating unit 23*a*, the money amount display unit 24 and an adjustment switch actuating unit 25*a*.

The throw slot 22 is provided to enable the money amount storage medium 141 to be thrown therethrough into the renting machine unit 20. The throw slot 22 is provided at a position corresponding to a money amount storage media deposit unit 41 for reading/writing the amount of money from and to the money amount storage medium 141, which will be described hereafter. On the other hand, the dispensing slot 26 is provided on the number storage media issuing unit 43 for issuing the number storage medium 143 which will be described hereafter and functions as a slot for dispensing an issued number storage medium 143.

The renting switch actuating unit 23*a* is provided to externally operate a selecting switch 23 for sending information (or a signal) representative of the number of rented game media to the game machine main body 30. The renting switch actuating unit comprises three push buttons each corresponding to a predetermined amount of money. In the present embodiment, three push buttons correspond to three money denominations such as 100 yen coins, 500 yen coins and 1000 yen notes.

In the present invention, a predetermined number of game media which will be rented are directly replenished to the game media holding unit 32 from replenishing means 73 in the game apparatus 10 according to the request of the player as will be described hereafter.

In the present invention, the game media which are acquired by the player are not handed to the player, but a medium bearing the number of the acquired game media is given to the player. In the present embodiment, storage media are used for recording the number of the game media which were acquired by playing the game.

Figure 5:
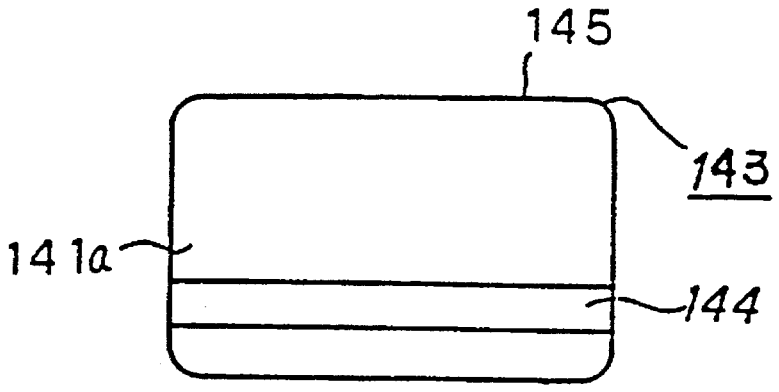
FIG. 5 is a front view showing an example of a number storage medium which is used in the present invention.

A number storage medium 143 which is shown, for example, in FIG. 5 is used as the storage medium in the present embodiment. The number storage medium 143 includes a rectangular board 145 and a number storing unit 144 for storing the number of game media as is similar to the money amount storage medium 141. The number storing unit 144 is formed on one side of the board 145 in the form of a magnetic recording strip. In other words, the number storage medium 143 functions as a magnetic card. Dates and places of game parlors can be stored in the number recording unit 144 in addition to the number of media.

Functional configuration of the present embodiment will be described with reference to FIG. 1.

The game apparatus 10 of the present embodiment comprises:

- a reception processing unit 11 for receiving input operations which are performed by a player who desires to rent game media and for outputting information representative of the number of rented game media;
- a replenishing processing unit 12 for processing the replenishing of the game media to the game media holding unit 32 according to the request of the player and for outputting information representative of the replenished game media;
- a score output unit 71 for outputting information representative of the number of game media given to the player as a score during performance of the game;
- a number managing unit 13 for accepting the information representative of the number of rented game media, the information representative of replenished game media and the information representative of the number of game media given to the player as a score to manage the number of game media acquired by the player in the game machine; and an adjustment processing unit 14 which in response to an instruction of adjustment accepts information representative of the number of game media possessed by the player, which is managed by the number managing unit 13 to output information representative of the number of game media to the storage medium.

The reception processing unit 11 comprises money amount reading means 61 for reading the amount of money from a valuable medium which is inserted from the outside of the apparatus, read money amount storing means 65 for temporarily storing the read amount of money, a renting switch 23 for accepting the specified amount of rented game medium and for outputting information representative of the number of game media which were specified for to rent, a money amount calculating means 66 for accepting the amount of money stored in the read money amount storing means 65 and information representative of the number of rented game media to calculate the amount money stored in the read money amount storing means and the amount of money corresponding to the number of rented game media. The apparatus of the present embodiment further includes money amount writing means 62 for writing the differences of the amounts of money calculated in the money amount calculating means 66 in the money amount storing unit 142 of the money amount storage medium 141.

In the present embodiment, the money amount storage medium 141 which is a storage medium having a money amount storing unit for physically storing the amount of money in the form of coded information is used as a valuable medium as mentioned above. Accordingly, the apparatus further includes a storage medium insertion unit 41 for accepting/ejecting the money amount storing medium 141 which is inserted from the outside of the apparatus. The storage medium insertion unit 41 has a guide mechanism, a positioning mechanism, a drive mechanism, etc. (not shown) which perform accept/ejection of the money amount storing medium 141. The money amount storage medium 141 relatively moves the money amount storage medium 141 with respect to a head of the money amount reading means 61 at a given speed when it accepts the money amount storage medium 141.

The money amount reading means 61 is capable of reading the stored amount of money from the money amount storing unit 141 of the money amount storage medium 141 which was inserted into the storage medium insertion unit 41. Specifically, the reading means 61 has a reading magnetic head and a drive circuit for the head, etc. and reads in the form of digital information the amount of money which is magnetically stored in the money amount storing unit 142. Read money amount storing means 65 is a memory for storing the read amount of money.

The renting switch 23, as is described above, has an operating unit 25*a* and sends information representative of the number of rented game media corresponding to the selected amount of money to the money amount calculating means 66 and the number storing unit 74 of the number managing unit 13 which will be described hereafter as an internal function although this is not illustrated in the drawing. Since the number of rented media is usually a fixed number, the information representative of the number of the rented medium may be a relevant code as well as a signal representing the number of the media per se. In order to rent the game media within the amount of the money stored in the inserted money amount storing medium 141, the renting switch 23 is adapted to accept a signal representative of the amount of money from the money amount storing means 66 and to select an amount of money within the inserted amount of money.

When information representative of the number of rented media is sent from the renting switch 23, the money amount calculating means 66 converts the information into the amount of money, and then reads the amount of money from the read money amount storing means 65 to calculate the difference between the read amount of money and the amount of money corresponding to the number of rented media.

The money amount difference writing means 62 writes the result of the calculation on the money amount storing unit 142 of the money amount storing medium 141 which has been inserted into the money amount storing medium throwing unit 41 for updating the stored amount of money. To this end, the money amount difference writing means 62 has a writing magnetic head and drive circuit for converting a money amount data into a signal suitable for magnetic recording to magnetically record the signal.

All or part of the functions of the read money amount storing means 65, the money amount calculating means 66, the money amount difference writing means 62 and the renting switch 23 may be achieved by the functions of a computer which will be described hereafter.

The above mentioned reception processing unit 11 is provided in the game media renting machine unit 20 in the present embodiment.

The replenishing processing unit 12 has a control capability for replenishing the game media within the number of media possessed by the player, which is managed in the number managing unit 13. The replenishing processing unit 12 comprises replenishing means 73 for replenishing the game media to the game media holding unit 32, a replenishing switch 35 for outputting an instruction to replenish the predetermined number of game media in response to a replenishing request from the outside of the apparatus and for outputting information representative of the number of replenished media, and a rental control unit 76 for controlling the replenishing means to perform the replenishment within the number of media possessed by the player, which is controlled by the number managing unit 13 when it accepts the replenishing instruction from the replenishing switch 35.

The replenishing switch 35 has the operation unit 35*a* as mentioned above. When the replenishing switch 35 receives a replenishing request signal from the operation unit 35*a*, it sends information representative of the predetermined number of rented media to the rental control unit 76 and the number calculating means 75 of the number managing unit 13. The information representative of the number of the replenished media may be information (or a signal) representative of the number of media per se.

Since the numbers of rented media are usually preset to predetermined numbers, the information may be corresponding code signals.

When the information representative of the number of replenished media is sent from the replenishing switch 35, the rental control unit 76 accepts a calculation result relating to a replenished number which is calculated in the number calculating means 75 as will be described hereafter, that is, the number of game media possessed by the player to determine whether it is negative or positive. If it is negative, replenishing is stopped since the number of game media replenished will exceed the number of game media possessed by the player. If the number of rented game media has such a relation that it is a fraction of the integer number of replenished game media, the number of replenished game media will not become a fraction.

The replenishing means 73 comprises a reservoir unit 73*a* for reserving the game media, a constant feeding unit 73*b* for feeding a predetermined number of game media to be reserved to the game media holding unit 32 in accordance with a control from the rental control unit 76, and a game media recovery unit 73*c* for recovering the game media inserted into the game performing unit 70 to the reserving unit 73*a*. Although the game media recovery unit 73*c* may be provided for each game apparatus, it is provided for each assembly of apparatus 100 shown in FIG. 8.

The game media which are replenished to the game media holding unit 32 are sent to the game performing unit 70. The game media which are left after game are sent to the game media recovery unit 73*c* via a game media recovery counter 73*d*. The count of the game media recovery counter 73*d* is sent to the number adding means 78 of the number managing unit 13.

The number managing unit 13 comprises a number storing unit 74 for storing the number of media possessed by the player, and a number updating unit 79*a* for updating the stored number of game media in the game machine.

The number storing unit 74 stores the number of rented game media and the number of game media possessed by the player. The number of rented game media is updated whenever rental is carried out. The number of game media possessed by the player is updated by the number updating unit 79*a*.

The number updating unit 79*a* includes operating means which accepts information representative of the number of rented game media, information representative of the number of replenished game media, information representative of the number of game media given to the player as a score and performs addition of the number of rented game media and the number of game media given to the player as a score and subtraction of the number of replenished game media to and from the respective numbers stored in the number storing unit and number rewriting means for rewriting the number of game media stored in the number storing unit 74.

The operating means includes a number operating means 75 for adding the number of rented game media to the number of possessed game media and for subtracting the number of replenished game media from the number of possessed game media and number adding means 78 for adding the number of game media given to the player from the score output unit 71 as a score to the number of the possessed game media. The number adding means 78 also performs an operation for adding the count of the game media recovery counter 73*d* to the number of possessed game media. The number adding means 78 may be omitted and the operation may be performed by the number operating means 75.

The number rewriting means includes number difference rewriting means 77 for writing the operation result of the number operating means 75 in the number storing means 74 and number difference rewriting means 79 for writing the operation result of the number adding means 78 in the number storing means 74. Alternatively, either one of the number difference rewriting means 77 and the number difference rewriting means 79 may be provided so that functions of both means can be achieved.

The number managing unit 13, as described above, includes the number display unit 34 for displaying the number of the game media stored in the number storing unit 74. When information on the-number of the newly rented game media is input to the number storing means 74 from the renting switch 23, the number display unit 34 displays the number and when the number is updated by the number updating unit 79a, it displays the number of possessed game media. Alternatively, the number of possessed media may be constantly displayed or the necessary number may be displayed by switching.

In the present embodiment, although a storage area for the number of rented media is provided, it may be omitted. In this case, the number of rented media is input to the number adding means 75 to be added with the number of possessed game media. The result is stored in the number storing means 74.

The above mentioned replenishing processing unit 12 and the number managing unit 13 are provided in the main body 30 of the game machine in the present embodiment. The rental control unit 76, the number storing unit 74 and the number updating unit 79*a* may be implemented by, for example, a computer which will be described hereafter.

The adjustment processing unit 14 comprises adjustment switches 25, 36 which accept an external adjustment request to output an adjustment instruction, an adjusted number storing means 67 for storing the adjusted number of game media, adjusted number transmitting means 72 which accepts the number of possessed game media managed by the number managing unit 13 from the number managing unit 13 to transmit it to the adjusted number storing unit 67 and the number writing means 63 for writing the number of game media stored in the adjusted number storing means 67 in the number storing unit 144 of the storage medium 143 issued by the number storage media issuing unit 43.

Figure 9:
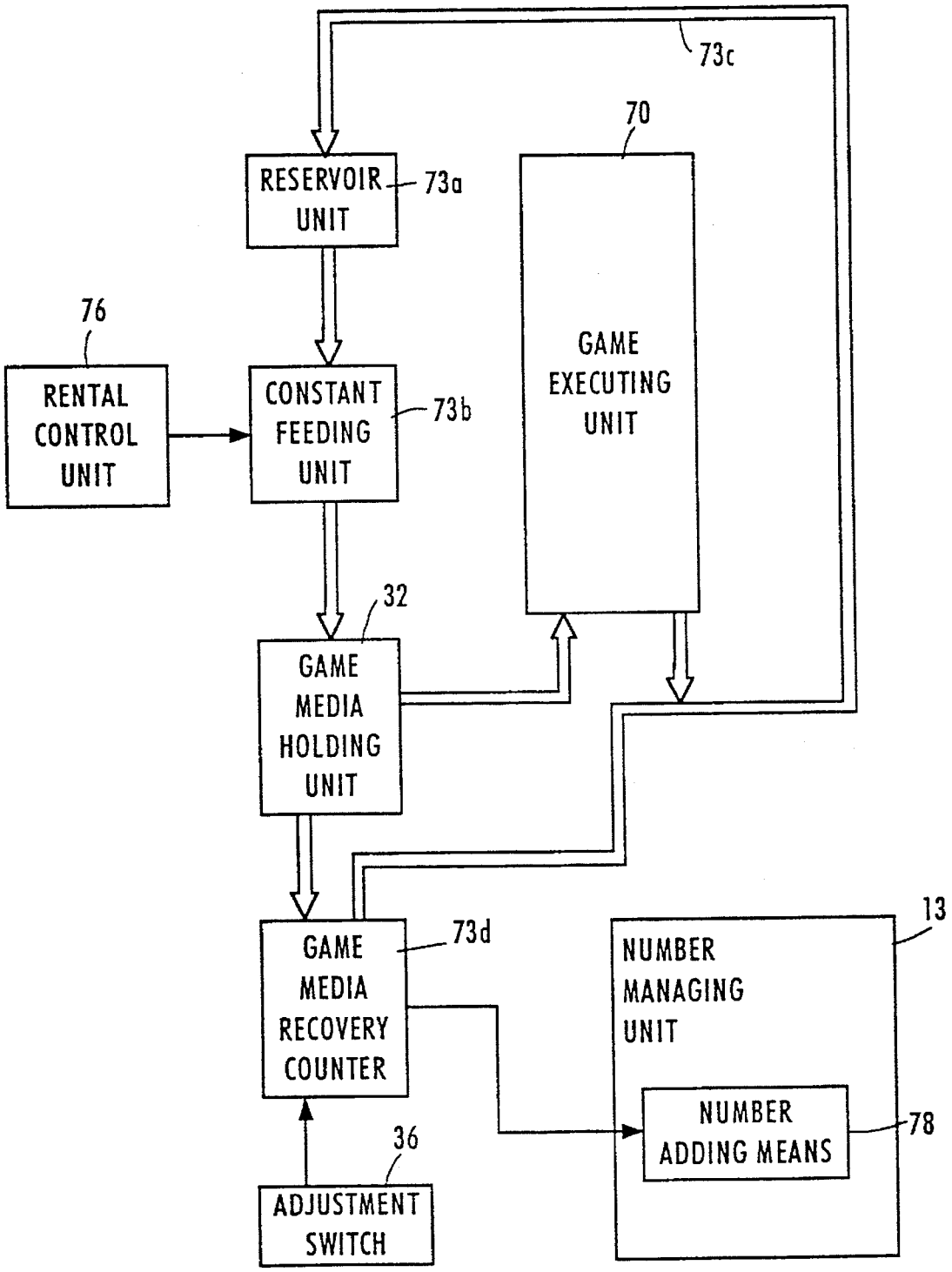
FIG. 9 is an explanatory view showing the outline of the structure of the replenishing means which is used in the present invention.

The adjustment switches 25 and 36 output an adjustment instruction to the game media recovery counter 73*d* shown in FIG. 9 as well as the adjusted number transmitting means 72.

The adjusted number transmitting means 72 reads the number of possessed media from the number storing unit 74 when it receives an adjustment instruction and the transmitting means transfers the number of possessed media to the adjusted number storing means 67. In order to conduct serial transfer, the data on the number is converted into serial data. If the game media recovery counter 73*d* is provided, reading of the number of possessed media from the number storing unit 74 is awaited until the recovering operation is completed.

The adjusted number storing means 67 is a memory for temporarily storing the number of adjusted game media transmitted from the adjusted number transmitting means 72. In the present embodiment, this storing means 67 comprises, for example, serial-in and serial-out registers.

The number writing means 63 comprises a writing magnetic head (not shown) for writing the number of adjusted media to be stored on the number storage medium 143 and a drive circuit for converting a data on the number into a signal suitable for magnetic storage for magnetic recording.

In the present embodiment, the adjustment processing means 14 has the adjustment switch 25, the adjustment number storing means 67, and the number writing means 63 which are provided in the game media renting machine unit 20. On the other hand, the adjustment switch 36, and the adjusted number transmitting means 72 are provided in the game machine main body 30. Part of the function of the adjustment number transmitting means 72 may be implemented by the function of a computer.

An example of the configuration of a hardware system which forms part of the information processing in each part of the present embodiment will be explained with reference to FIG. 7.

As shown in FIG. 7, the game media renting machine unit 20 and the game machine main body 30 are formed by computer systems having different hardware, respectively. Of course, a structure for information processing of both units may be formed by a single computer system.

The computer system of the game media renting machine unit 20 comprises a central processing unit (CPU) 201, a memory 202 and an interface 203. A renting switch circuit 204, an adjusting switch circuit 205, a card reader/writer 206, a card issuing machine 207 and a cash display unit 24 are connected to the computer system via an interface 203. A communication port 208 is provided, which is connected with a communication port 308 of the game machine body 30 via a transmission line 400.

The renting switch circuit 204 and the adjusting switch 205 are internal circuits of the renting switch 23 and the adjusting switch 25, respectively. The card reader/writer 206 functions as the money amount storage media insertion unit 41, the money amount reading means 61 and the money amount difference writing means 62. The card issuing machine 207 functions as the number storage media issuing machine unit 43 and the number writing means 63. The cash display unit 24 displays the remaining amount stored in the inserted money amount storage medium 141.

The computer system of the game machine main body 30 comprises a central processing unit (CPU) 301, a memory 302 and an interface 303. A replenishing switch circuit 304, the adjusting switch circuit 305, the above mentioned number display unit 34 and the above mentioned replenishing means 73 are connected with the computer system via an interface 303. A communication port 308 is provided.

The replenishing switch circuit 304 and the adjusting switch 305 are internal circuits of the replenishing switch 35 and the adjusting switch 36, respectively.

Operation of the present embodiment will be described.

Figure 3:
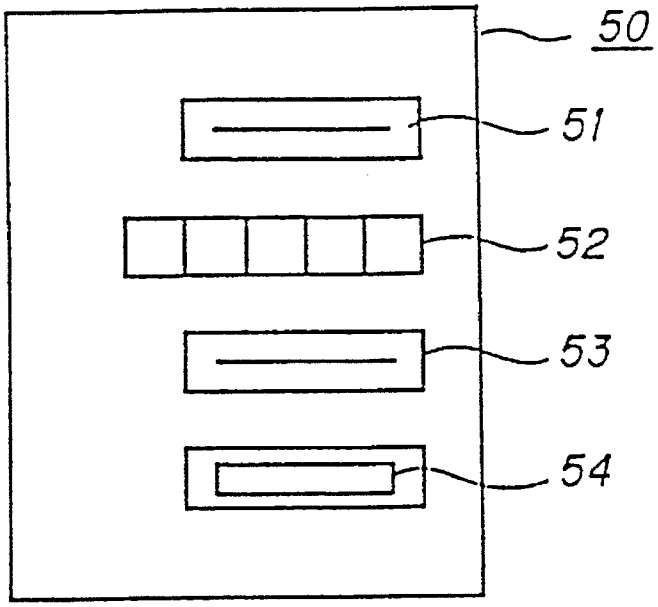
FIG. 3 is a front view of an example of a storage media vending machine which is used in the present invention.

The storage media vending machine 50 shown in FIG. 3 issues a money amount storage medium 141 in response to player's operation and the payment. The storage medium vending machine 50 writes information representative of an amount of money on the money amount storing unit 142 of the money amount storing medium 141 and ejects the medium 141.

When a player inserts the money amount storing medium 141 into an insertion slot 22, reading/writing of data from and to the money amount storing unit 142 is performed by the card reader/writer 207 in the game media renting machine unit 20. In other words, the money amount storage medium 141 is internally accepted by the money amount storage media insertion unit 41 and is moved with respect to the magnetic head of the money amount reading means 61 so that the stored content of the money amount storing unit 142 is read. Information representative of the read amount of money is converted into digital data and then stored in the read money amount storing means 65. The read amount of money is displayed on the cash display unit 24. Information on the amount of money stored in the read money amount storing means 65 is also fed to the renting switch 23.

The renting switch 23 is controlled so that only the operation unit **23*a* relevant to the amount of money is enabled to actuate by the internal switch circuit 204**.

When the player actuates the operation unit **23*a* of the renting switch, the renting switch 23 sends information representative of the number of media to be rented corresponding to the manipulation to the money amount operating means 66 and the number storing means 74**.

The money amount operating means 66 calculates the difference between the amount of money stored in the read money amount storing means 65 and the amount of money relevant to the information representative of the number of rented game media from the renting switch 23. This function is performed as one of the functions of the CPU 201. The money amount difference writing means 62 rewrites the money amount difference on the money amount storing unit 142 of the money amount storage medium 141. This achieves the management of the amount of money on the money amount storage medium 141.

Alternatively, after writing the money amount difference, the content stored in the money amount storing unit 142 of the money amount storage medium 141 may be read by the money amount reading means 61 and stored in the read money amount storing means 65. Alternatively, writing of the money amount difference is not carried out each time, but writing may be carried out when the adjusting switch 25 and 36 is operated for adjustment.

In the game machine main body 30, the medium number storing means 74 stores the number of game media corresponding to information representative of the number of rented game media fed from the renting switch 23. In this case, if the information representative of the number of rented media is data directly representing the number of media, the data per se is stored. If the information is not data representing the number of media, but a code, this code is converted into the number of media. This conversion may be conducted by reference to a table defining the relation between the codes and the numbers. This is common to the other parts or to the other embodiments which will be described hereafter.

When the new number of rented media is stored in the rented media number storing area of the number storing means 74, the number display unit 34 displays it. The number operating means 75 adds the new number of rented media to the number of possessed media and stores the sum in the number storing means 74. When the number of rented media is an initial presetting, or the number of possessed media is zero, the number of the rented media is stored as the number of possessed media.

When the player manipulates the operation unit 35 of the replenishing switch 35, the replenishing switch 35 causes the switch circuit 205 to send information representative of the number of replenished media to the number operating unit 75 and the rental control unit 73.

The number operating means 75 determines the difference between the numbers of possessed and replenished game media. This difference is written on the number storing unit 74 by the number difference rewriting means 77 to update the number of possessed media. The number of game media stored in the number storing means 74 is displayed by the number display unit 34.

The rental control unit 76 controls the rental of the game media within the number of possessed game media stored in the number storing means 74. Determination as to whether or not the number of media to be rented is larger than the number of possessed media is carried out with reference to the operation result of the number operating means 75 as mentioned above. The replenishing means 73 replenishes the game media under control of the rental control unit 76. In other words, the game media which are as many as the instructed number are paid out to the game medium holding unit 32.

This obviates the operation in which the player conventionally has taken the game media from the game medium renting machine unit 20 to put them into the rented media holding unit 32 of the game machine main body 30.

A game can be performed on the board 31 by operating a lever 33 in the game machine main body 30. In the game machine main body 30, information representative of the number of game media is output from the score output unit 71 as scores in accordance with hits in the game. The number adding means 78 adds the number of media stored in the number storing means 74 to the number of media relevant to the information output as a score. The sum rewriting means 79 rewrites the number of media stored in the number storing means 74 into the new number of possessed media which was determined by the number adding means 78.

As is apparent from the foregoing description, the game media are not directly given to the player on rental of the game media. When the replenishing switch 35 instructs to replenish the media, the game media which are as many as the instructed number are replenished to the game media holding unit 32. Also when a hit is made during the game, a signal representing a hit is output to add the corresponding to the number of possessed media.

When the game is completed, the number of possessed media which is stored in the number storing means 74 from the adjustment number transmitting means 72 in accordance with the manipulation of the adjustment switch 25 or 36 is sent to the adjustment number storing means 67 as an adjustment number and is temporarily stored therein. The number of adjusted game media to be stored is written on the number storing unit 144 of the number storage medium 143 issued by the card issuing machine 207. In other words, the number writing means 63 writes the number of the adjusted media stored in the adjustment number storing means 67 on the number storage medium issued by the number storage media issuing part 43.

This achieves the management of the number of possessed game media in the number storage medium 143. An operation in which the game media which are acquired as a score are transferred from the game media holding unit 32 to a counter is not necessary. If the player brings this number storage medium to a prize exchange booth, he or she can get prizes depending upon the number of acquired game media.

Figure 6:
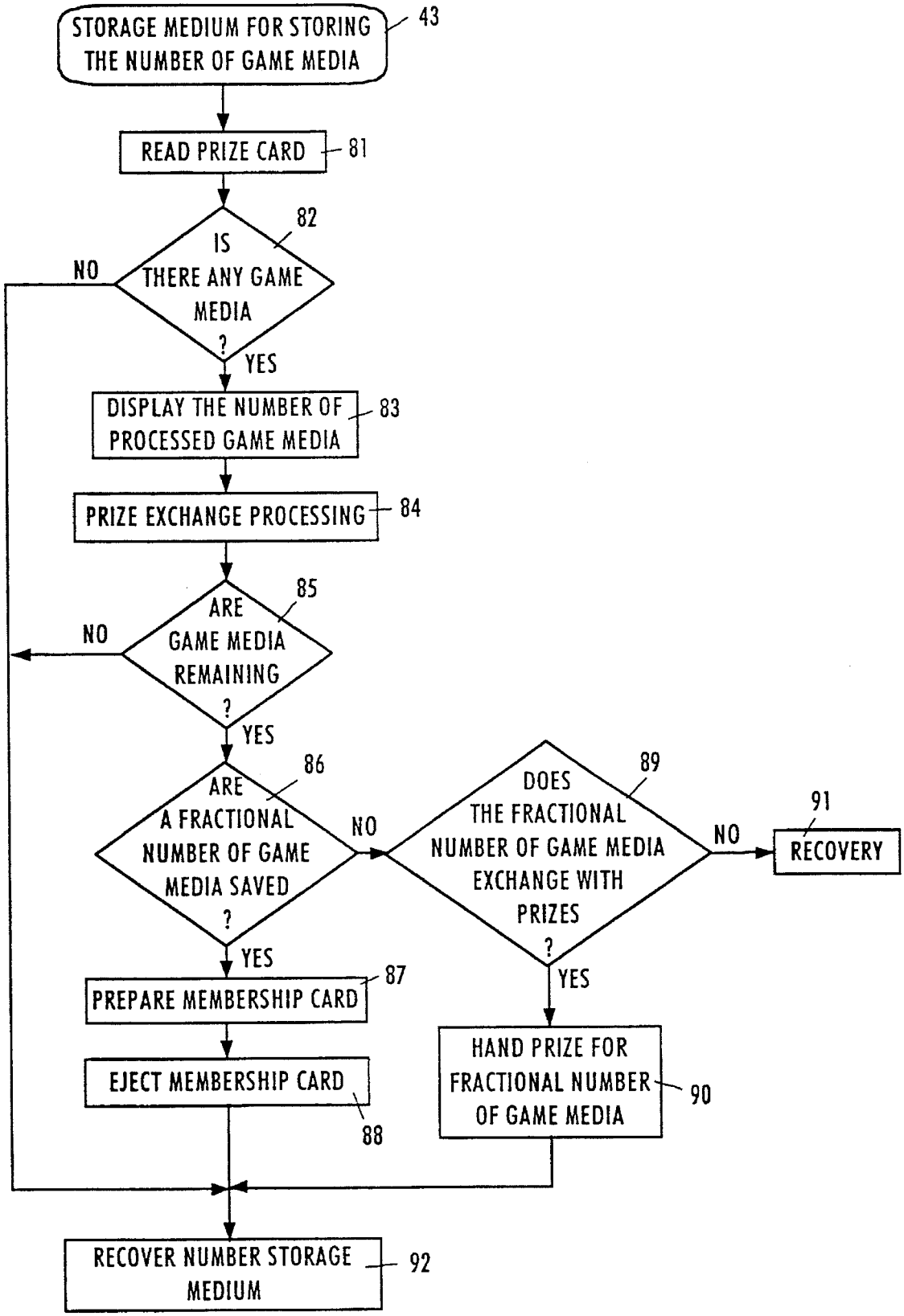
FIG. 6 is a flow chart for the processing of the number storage medium, which is used in the first embodiment of the present invention.

Specifically, as shown in FIG. 6, the number storage medium 143 is put into the prize card reader 60 in the prize exchange booth to display the number of possessed game media, if any, for carrying out prize exchange processing (steps 81, 82, 83 and 84).

There may be provided a restriction that the exchange of the number of possessed game media stored in the number storage medium 143 with prizes is allowed only on the date of the game. Alternatively, the number storage medium may be specific in the game parlor so that it can not be used at an other game parlor.

If fractional game media are left after exchanging with the prizes, the fractional game media may be saved. In this case, a membership card bearing the number of fractional game media may be issued and handed to the player (steps 85, 86, 87 and 88). If the fractional game media are not saved, a prize or prizes are handed to the player or a recovery processing is conducted (steps 89, 90 and 91 ).

If there are no game media remaining after playing the game or no fractional game media remain after exchange with prizes, issuance of the membership card or after prizes are handed, the number storage medium 143 is internally recovered (step 92).

In such a manner, the game media renting machine unit 20 is capable of managing the amount of money by means of the money amount storage medium 141 and is capable of managing the number of possessed game media by means of the number storage medium 143.

Only the number of possessed game media is stored in the storing unit 44 of the number storage medium 143. The medium 143 is handled separately from the money amount storage medium 141 and can be used for exchange with prizes. Accordingly, the money amount storage medium 141 may be an existing medium and may be used without changing its format.

Home cards other than prepaid cards can be used as the money amount storage medium.

In the game apparatus, the game media renting machine unit may be mounted on the upper or lower portions of the game machine main body as well as the side thereof.

Since the game apparatus of the present invention makes it possible to replenish the game media by managing the amount of money with the money amount storage medium and makes it possible to exchange with the prizes by managing the number of possessed game media. Transferring of the game media is not necessary. Losses of the game media due to dropping during transferring can be prevented.

Since the game media are not discharged externally of the game apparatus 10, the total number of game media therein never changes. Therefore, the number of the game media in a game apparatus or an assembly including the game apparatus never changes. Thus, it is not necessary to adjust the number of game media between the game apparatus and the other game apparatus or between the assembly and the other assembly.

These effects can be found in the other embodiments which will be described hereafter as well as in the present embodiment.

Next, the other embodiments of the present invention will be described with reference to drawings. The basic constructions of these embodiments are substantially the same as the above mentioned first embodiment, the distinction there between will be described mainly.

Figure 10:
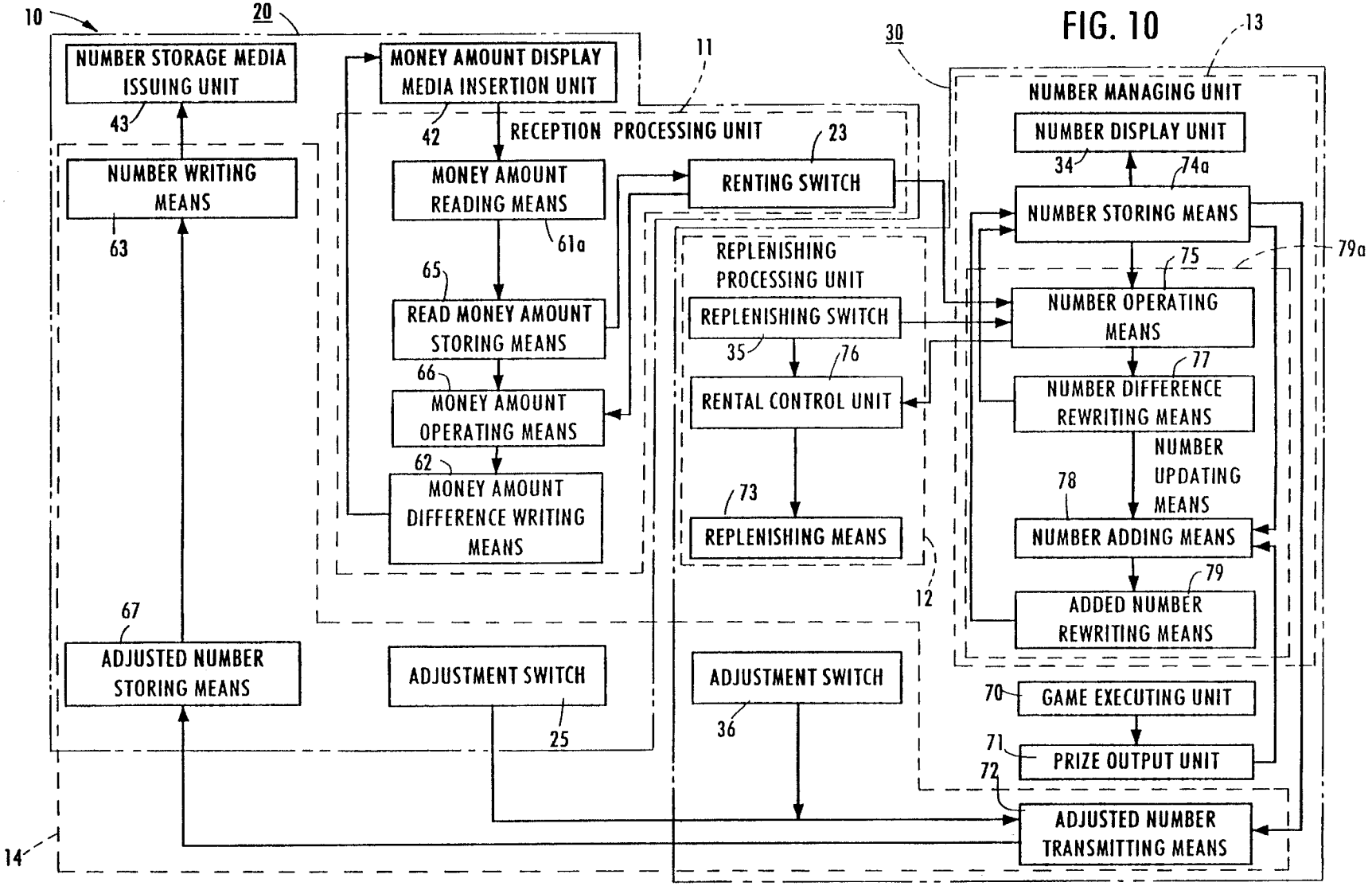
FIG. 10 is a block diagram showing the structure of a second embodiment of the present invention.

The second embodiment will be described with reference to FIG. 10.

In the present embodiment, a money amount display medium having a display for physically displaying the amount of money in the form of image information is used as a valuable media. An example of the money amount display medium is bank notes.

The present embodiment includes a display medium insertion unit 42 for at least accepting the money amount display medium which is inserted from the outside of the apparatus. A reception processing unit 11 has a money amount reading means **61*a* which is constitutionally different from the first embodiment. The money amount reading means 61*a* has a function capable of reading the amount of money displayed on a display unit of the money amount display medium which is inserted into the display medium insertion unit 41**. Here, reading the amount of money displayed means not only reading the numbers displaying the amount of money directly but also identifying a characteristic patten of an image so as to ascertain the money amount. For example, the values of the notes can be ascertained from their characteristic printing patterns. The process after the money valve is ascertained is the same as the first embodiment.

The second embodiment has an element, a storage media issuing unit **43*a*, which the first embodiment does not have. This differs from the number storage media issuing unit 43 in that a change can be written on the storage media medium by the money amount difference writing means 62**.

Figure 11:
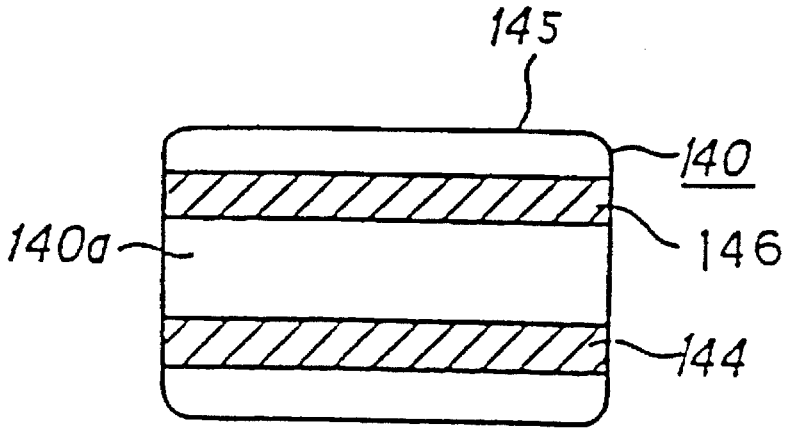
FIG. 11 is a front view showing another example of the storage medium which is used in the present invention.

In this case, the storage medium may comprise a board 145 and two magnetic recording stripes provided thereon as shown in FIG. 11. One of two magnetic strips is a number storing unit 144 and the other is a money amount storing unit 146. An arrangement in which two items of information are written on a single magnetic recording strips by a common writing head. In this case, writing means as shown in FIGS. 4 and 5, may be used.

Although the storage media issuing unit 43*a* is arranged to reserve the storage medium and to eject each of them, it may be arranged to insert each storage medium from the outside thereof.

In the present embodiment, the number storing unit 74*a* does not store the number of rented game media. The operation result of the number operating means 75 is stored in the number storing unit 74*a*.

Figure 12:
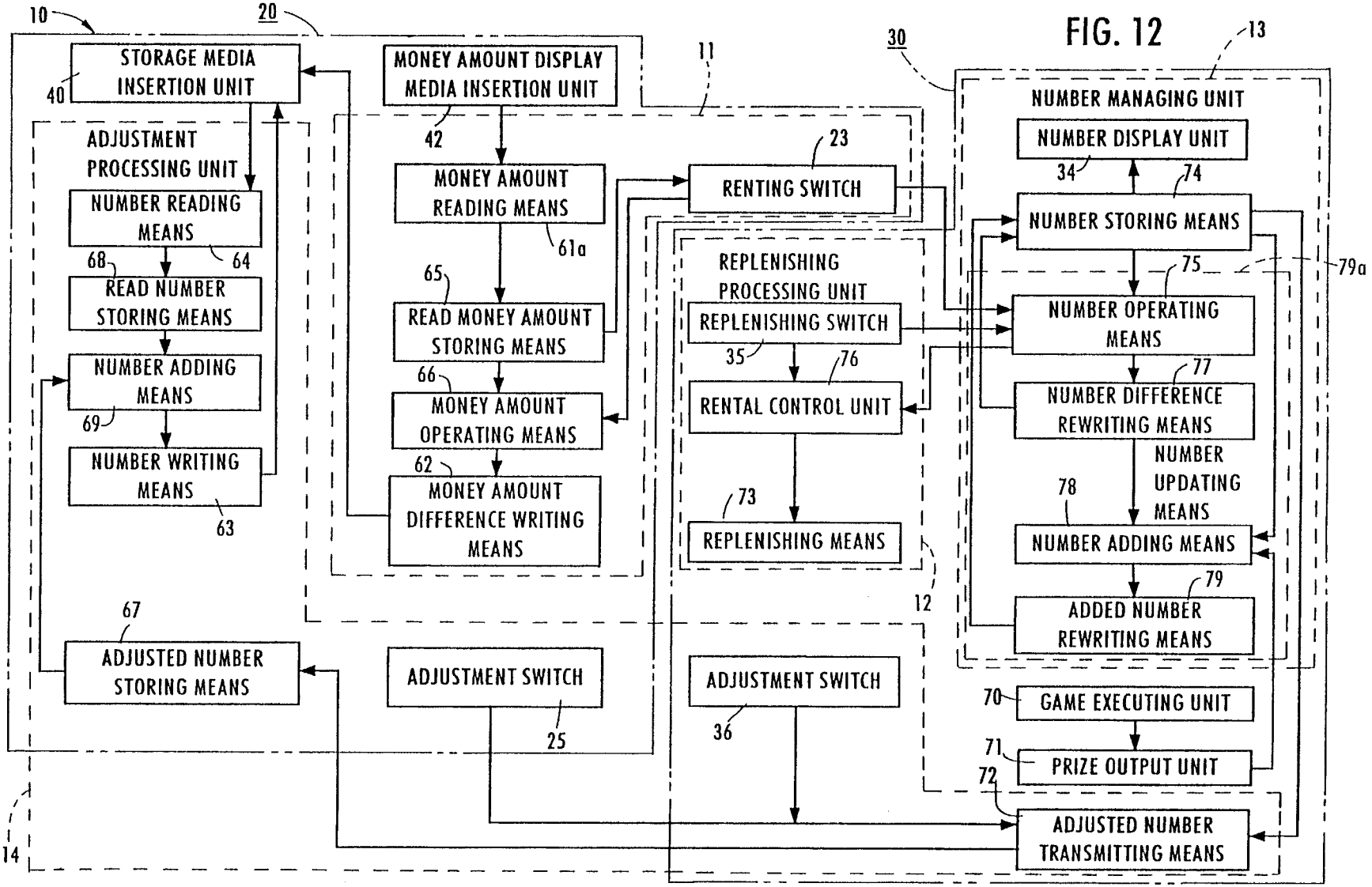
FIG. 12 is a block diagram showing the structure of a third embodiment of the present invention.

A third embodiment of the present invention is shown in FIG. 12. In the present embodiment, there is provided a storage medium insertion unit 40 for inserting a storage medium on which the number of the adjusted game media is written. In connection with this, the adjustment processing unit 14 comprises number reading means 64 for reading information on the number of game media stored in the storage medium, read number storing means 68 for temporarily storing the result of reading, number adding means 68 for adding the number of adjusted game media stored the adjustment number storing means 67 to the number represented by the information stored in the read number storing means 68. The result of the addition is written into the number storing unit of the storage medium to update it.

In the present embodiment, a storage medium is vended by the storage media vending machine 50. The other features are similar to those in the foregoing second embodiment.

Figure 13:
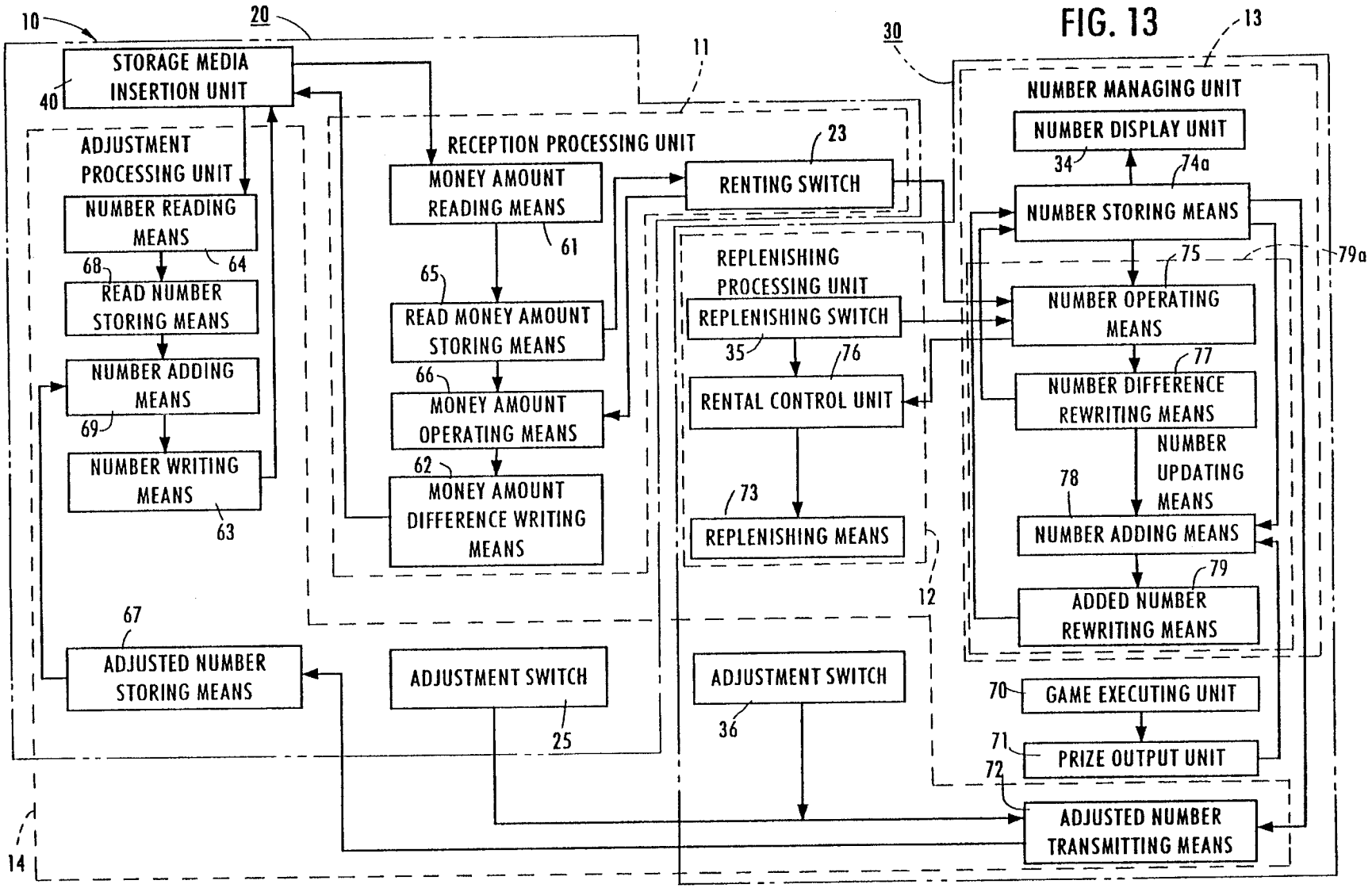
FIG. 13 is a block diagram showing the structure of a fourth embodiment of the present invention.

A fourth embodiment of the present invention is shown in FIG. 13. In this embodiment, an amount of money for rental of the game media is determined from a storage medium inserted into the storage medium throw-in unit 40. This feature is similar to that in which the money amount storage medium of the first embodiment is used. The other structural features are similar to those of the third embodiment.

In the present embodiment, the storage medium is vended by the storage medium vending machine 50.

Exchange of the storage medium having a money amount storing unit and the number storing unit with a prize or prizes will be described with reference to FIG. 14.

Figure 14:
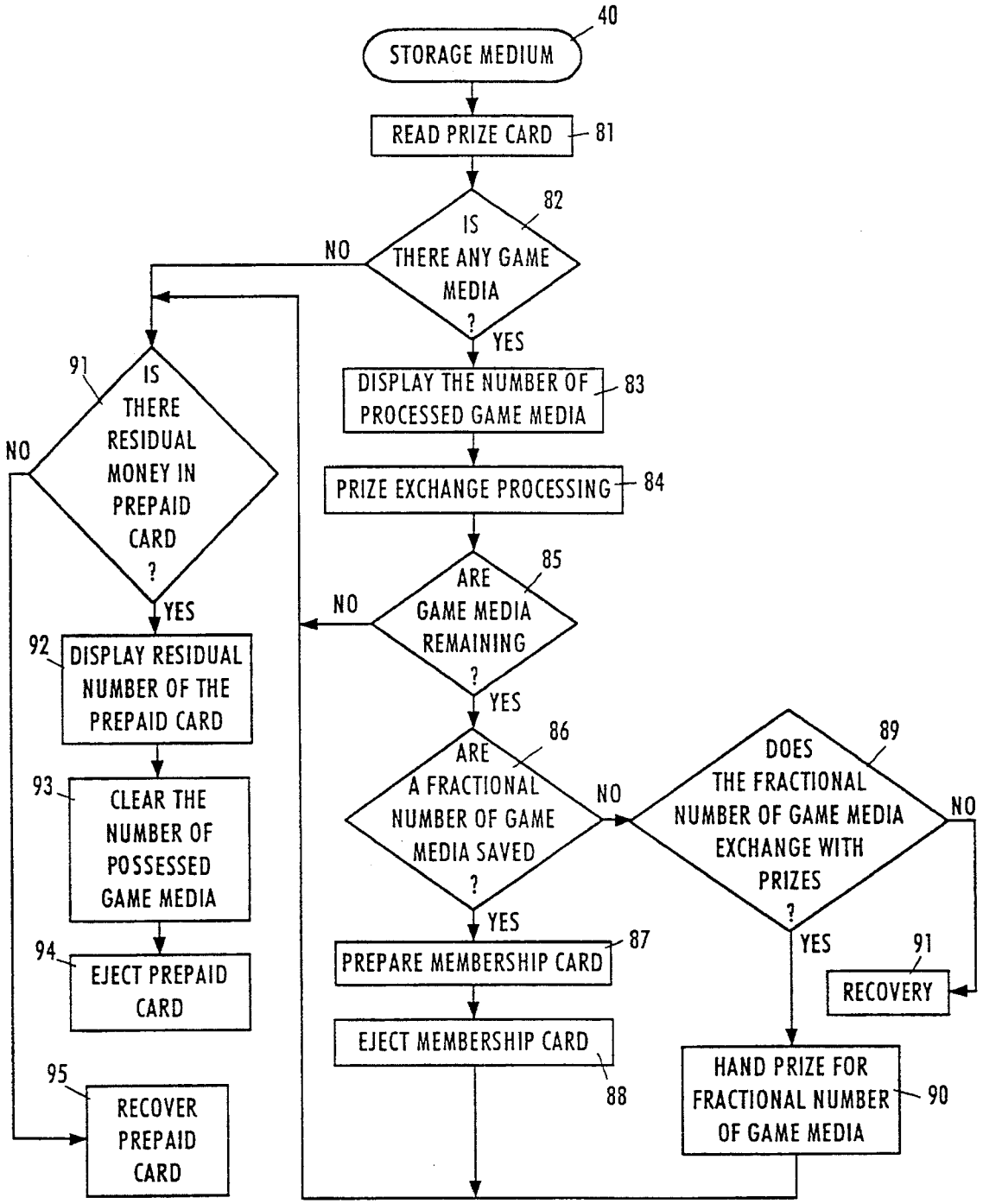
FIG. 14 is a flow chart for another processing of the number storage medium which is used in the present invention.

As shown in FIG. 14, the storage medium 140 is put into the score card reader 60 in the prize exchange booth. If the number of game media is stored in the number storing unit of the storage medium, that is, the player possesses a given number of game media, the number of possessed game media is displayed and prize exchange processing is conducted as mentioned above (steps 81, 82, 83, 84). If there are any game media remaining after exchanging with the prizes, the fractional number of game media can be saved. In this case, a membership card bearing the fractional number of game media can be issued and ejected (steps 85,86, 87, 88). If the fractional number of game media is not saved, a prize for the fractional number of game media is handed, and prize exchange processing is conducted (steps 89, 90).

If no game media are remaining after exchange with prizes, a membership card is issued or a prize for a fractional number of game media is handed, and it is determined whether an amount of money is stored in the storage medium 40. If it is stored, the remaining amount of money is displayed on the remaining money display unit 24 to eject the storage medium 40 (steps 91, 92, 93, 94). If no money remains, the storage medium 140 is recovered therein (step 95).

Although various types of storage media are used in the foregoing embodiments, the storage media may be unified into a form shown in FIG. 11. This obviates the necessity to provide various kinds of storage media even if various types of game apparatus are provided in the same game parlor like the above mentioned embodiments. If the game apparatus are changed, game media vending machines need not be changed since the storage media can be used. Since the card readers/writers having identical structure can be used, unification of the game apparatus becomes easier.

What is claimed is:

1. A game apparatus having a game executing unit for playing a game using game media and a game media holding unit for temporarily holding the game media used in the game, and being capable of controlling a game media, the game apparatus comprising:

a reception processing unit for receiving input operations which are performed by a player who desires to rent game media and for outputting information representative of a number of rented game media;

a replenishing processing unit for processing a replenishment of the game media to the game media holding unit according to the request of the player and for outputting information representative of the replenished game media;

a score output unit for outputting information representative of a number of game media given to the player as a score during performance of the game;

a number managing unit for accepting the information representative of the number of the rented game media, the information representative of replenished game media and the information representative of the number of game media given to the player as a score to manage the number of the game media acquired by the player in the game machine;

a number storage medium issuing unit for issuing a number storage medium having a number storing portion which stores information representative of the number of game media for the player; and an adjustment processing unit which, in response to an instruction of adjustment from outside of the apparatus, accepts information representative of the number of game media possessed by the player, which is managed by said number managing unit, so as to output information representative of the number of game media to said number storage medium issuing unit, said replenishing processing unit having a control capability to replenish the game media within the number of the game media possessed by the player.

2. A game apparatus as defined in claim 1 in which the reception processing unit comprises:

money amount reading means for reading information representative of an amount of money from a valuable medium having information representative of the amount of money and having a value corresponding to the amount of money represented by the information, which is inserted from the outside of the apparatus;

read money amount storing means for temporarily storing the read amount of money, a renting switch for accepting the specification of the amount of rented game medium and for outputting information representative of the number of the game media which were accepted to rent, and money amount calculating means for accepting the amount of money stored in said read money amount storing means and information representative of the number of the rented game media and for calculating a difference between the amount of money stored in said read money amount storing means and the amount of money corresponding to the number of the rented game media.

3. A game apparatus as defined in claim 2 in which a money amount storage medium having a money amount storing unit for physically storing the amount of money in the form of coded information is used as a valuable medium and further including a storage medium insertion unit for accepting/ejecting the money amount storage medium which is inserted from the outside of the apparatus, said money amount reading means being capable of reading the stored amount of money from the money amount storing unit of the money amount storage medium which was inserted into the storage medium insertion unit.

4. A game apparatus as defined in claim 3 in which said reception processing unit further includes money amount difference writing means for writing the difference of the money amount calculated by said money amount calculating means on the money amount storing unit of the money amount storage medium.

5. A game apparatus as defined in claim 2 in which a money amount storage medium having a money amount storing unit for physically storing the amount of money in the form of coded information is further used as a valuable medium and further including a storage medium insertion unit for accepting/ejecting the money amount storage medium which is inserted from the outside of the apparatus, said reception processing unit further including money amount difference writing means for writing the difference of the money amount calculated by said money amount calculating means on the money amount storing unit of the money amount storage medium which is inserted into said storage medium insertion unit.

6. A game apparatus as defined in claim 2, further including a display medium insertion unit for accepting a money amount display medium, inserted from the outside of the apparatus, the money amount display medium having a money amount display portion physically displaying the amount of money in the form of image information, and wherein said money amount reading means is capable of reading the displayed amount of money from the money amount display portion of the money amount display medium so inserted.

7. A game apparatus as defined in claim 6 in which said money amount display medium is paper money.

8. A game apparatus as defined in claim 2, wherein:

said number storage medium issuing unit issues a number storage medium having a number storing portion for storing the number of the game media and a money amount storing portion for storing money amount, the adjustment processing unit comprises:

a number reading means for reading the stored number on the number storing portion of the number storage medium which is inserted in the storage medium insertion unit, a read number storing means for temporarily storing the number of game media, adjustment switches which accepts an external adjustment request to output an adjustment instruction, an adjusted number storing means for storing the number of adjusted game media, adjusted number transmitting means which accepts the number of possessed game media managed by the number managing unit from the number managing unit to transmit it to the adjusted number storing means, number adding means for adding the number of game media stored in said adjusted number storing means to the number of game media stored in the read number storing means, and number writing means for writing the result of the addition on the number storing portion of said number storage medium, and said reception processing unit further includes money amount difference writing means for writing the difference of the money amount calculated by said money amount calculating means on the money amount storing portion of said number storage medium.

9. A game apparatus as defined in claim 8, wherein:

said number storage medium issuing unit stocks, in advance, a number storage medium to be issued, so as to issue the number storage medium at every adjustment process of said adjustment processing unit; and said number storage medium includes a card-shaped board and a magnetic recording area used as a number storing portion and a money amount storing portion formed on a part of the board.

10. A game apparatus as defined in claim 8, further comprising a game media collection and counting means for collecting the game media held in the said game media holding unit into the game apparatus and for counting the number of the game media in response to an instruction of adjustment, said game media collection and counting means being adapted to transmit the result of the counting to the said number managing unit.

11. A game apparatus as defined in claim 10 in which the replenishing processing unit comprises:

replenishing means for replenishing the game media to the game media holding unit;

a replenishing switch for outputting an instruction to replenish a predetermined number of game media in response to a replenishing request from the outside of the apparatus and for outputting information representative of the number of replenished media; and a rental control unit for controlling the replenishing means to perform the replenishment within the number of media possessed by the player, which is controlled by the number managing unit when it accepts the replenishing instruction from the replenishing switch.

12. A game apparatus as defined in claim 11 in which the replenishing means comprises a reservoir unit for storing the game media, a constant feeding unit for feeding a predetermined number of game media to be stored to the game media holding unit in accordance with a control from the rental control unit and a game media recovery unit for recovering the game media inserted into the game performing unit and the game media collected and counted in the said game media collection and counting means respectively to the reservoir unit.

13. A game apparatus as defined in claim 10 in which the number managing unit comprises a number storing unit for storing the number of media possessed by the player, and a number updating unit for updating the stored number of game media in the game machine, said number updating unit includes operating means which accepts information representative of the number of rented game media, information representative of the number of replenished game media, information representative of the number of game media given to the player as a score and subtraction of the number of replenished game media from the respective numbers stored in the number storing unit and number rewriting means for rewriting the number of game media stored in the number storing unit.

14. A game apparatus as defined in claim 13 in which the number managing unit further includes the number display unit for displaying the number of game media stored in the number storing unit.

15. A game apparatus as defined in claim 14 in which the operating means has a capability of adding the number of the unused game media transmitted as a result of the counting from the said game media collection and counting means to the number of game media stored in the number storing unit.

16. A game apparatus as defined in claim 1 in which the replenishing processing unit comprises:

replenishing means for replenishing the game media to the game media holding unit;

a replenishing switch for outputting an instruction to replenish a predetermined number of game media in response to a replenishing request from the outside of the apparatus and for outputting information representative of the number of replenished media; and a rental control unit for controlling the replenishing means to perform the replenishment within the number of media possessed by the player, which is controlled by the number managing unit when it accepts the replenishing instruction from the replenishing switch.

17. A game apparatus as defined in claim 16 in which the replenishing means comprises a reservoir unit for storing the game media, a constant feeding unit for feeding a predetermined number of game media to be stored to the game media holding unit in accordance with a control from the rental control unit and a game media recovery unit for recovering the game media inserted into the game performing unit to the reservoir unit.

18. A game apparatus as defined in claim 1 in which the number managing unit comprises a number storing unit for storing the number of media possessed by the player, and a number updating unit for updating the stored number of game media in the game machine, said number updating unit includes operating means which accepts information representative of the number of rented game media, information representative of the number of replenished game media, information representative of the number of game media given to the player as a score and performs addition of the number of rented game media to the number of game media given to the player as a score and subtraction of the number of replenished game media from the respective numbers stored in the number storing unit and number rewriting means for rewriting the number of game media stored in the number storing unit.

19. A game apparatus as defined in claim 18 in which the number managing unit further includes the number display unit for displaying the number of game media stored in the number storing unit.

20. A game apparatus as defined in claim 19 in which the operating means has a capability of adding the number of the unused game media recovered from the game media holding unit to the number of game media stored in the number storing unit.

21. A game apparatus as defined in claim 1 wherein said adjustment processing unit comprises:

adjustment switches which accept an external adjustment request to output an adjustment instruction, an adjusted number storing means for storing the number of the adjusted game media, adjusted number transmitting means which accepts the number of the possessed game media managed by the number managing unit from the number managing unit to transmit it to the adjusted number storing unit, and number writing means for writing the number of game media stored in the adjusted number storing means on the number storing portion of the number storage medium issued by the number storage medium issuing unit.

22. A game apparatus as defined in claim 21, in wherein:

said number storage medium issuing unit stocks, in advance, a number storage medium to be issued, so as to issue the number storage medium at every adjustment process of said adjustment processing unit; and said number storage medium includes a card-shaped board and a magnetic recording area used as a number storing portion formed on a part of the board.

23. A game apparatus as defined in claim 1 wherein:

said number storage medium issuing unit includes a storage medium insertion unit for accepting/ejecting said number storage medium inserted from outside of the apparatus, and the adjustment processing unit comprises:

a number reading means for reading the stored number on the number storing portion of said number storage medium which is inserted in the storage medium insertion unit, a read number storing means for temporarily storing the number of game media, adjustment switches which accept an external adjustment request to output an adjustment instruction, an adjusted number storing means for storing the number of adjusted game media, adjusted number transmitting means which accepts the number of possessed game media managed by the number managing unit from the number managing unit to transmit it to the adjusted number storing unit, number adding means for adding the number of game media stored in said adjusted number storing means to the number of the game media stored in the read number storing means, and number writing means for writing the result of said adding on the number storing portion of said number storage medium.

* * * * *